US010907927B2

(12) United States Patent
Rankhorn

(10) Patent No.: US 10,907,927 B2
(45) Date of Patent: Feb. 2, 2021

(54) ARCHERY BOW RELEASE

(71) Applicant: Rankhorn Evolved Designs, Boone, NC (US)

(72) Inventor: Michael L. Rankhorn, Boone, NC (US)

(73) Assignee: Rankhorn Evolved Designs, Boone, NC (US)

( * ) Notice: Subject to any disclaimer, the term of this patent is extended or adjusted under 35 U.S.C. 154(b) by 0 days.

(21) Appl. No.: 16/739,717

(22) Filed: Jan. 10, 2020

(65) Prior Publication Data

US 2020/0224995 A1 Jul. 16, 2020

Related U.S. Application Data

(60) Provisional application No. 62/791,272, filed on Jan. 11, 2019.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/31, 35.2, 37
See application file for complete search history.

(56) References Cited

U.S. PATENT DOCUMENTS

| | | | | | |
|---|---|---|---|---|---|
| 3,347,575 | A * | 10/1967 | Morris | F16B 7/105 | 403/107 |
| 4,403,594 | A * | 9/1983 | Todd | F41B 5/1469 | 124/35.2 |
| 4,476,845 | A * | 10/1984 | Rickard | F41B 5/1469 | 124/35.2 |
| 4,791,908 | A * | 12/1988 | Pellis | F41B 5/1469 | 124/35.2 |
| 4,860,720 | A * | 8/1989 | Todd | F41B 5/1469 | 124/35.2 |
| 4,926,835 | A * | 5/1990 | Peck | F41B 5/1469 | 124/35.1 |
| 5,070,854 | A * | 12/1991 | Peck | F41B 5/1469 | 124/31 |
| RE34,126 | E * | 11/1992 | Todd | F41B 5/1469 | 124/35.2 |
| 5,435,291 | A * | 7/1995 | Woodward | F41B 5/1469 | 124/35.2 |
| 5,439,231 | A * | 8/1995 | Roberts | F41B 5/1469 | 124/31 |
| 5,566,664 | A * | 10/1996 | Todd | F41B 5/1469 | 124/35.2 |
| 2003/0019488 | A1* | 1/2003 | Eckert | F41B 5/1469 | 124/35.2 |

* cited by examiner

*Primary Examiner* — John E Simms, Jr.
(74) *Attorney, Agent, or Firm* — NK Patent Law

(57) ABSTRACT

The present application discloses an archery bow release that can be used to aid bow string release in archery. The bow release disclosed in the present application comprises a center carrier and a sleeve cylinder housing that receives the center carrier from the back end. The center carrier comprises a chamber, a lock mechanism and a string releaser. The lock mechanism locks and releases the center carrier. The string releaser holds the loop bow string when the center carrier is locked and releases the loop bow string when the center carrier is released.

19 Claims, 21 Drawing Sheets

ARCHERY BOW RELEASE

RELATED APPLICATIONS

The present application claims priority to U.S. Provisional Application No. 62/791,272 titled Archery Bow Release Mechanism and filed on Jan. 11, 2019, the content of which is hereby incorporated in its entirety.

TECHNICAL FIELD

The present disclosure relates generally to archery bows, and more specifically to an archery bow release.

BACKGROUND

There are two types of archery bows: traditional and compound bows. Traditional bows are structurally simple. Traditional bows often are made of two components, a bow and a bow string. The bow generally comprises an upper limb, a lower limb, and a riser. The riser usually includes a hand grip and an arrow rest for holding an arrow. At the middle point of the bow string, a nocking point is installed to nock an arrow for keeping the arrow in place. Compared to traditional bows, compound bows are a modern invention. They are complex and built with sophisticated technologies. They are often made of aluminum or carbon materials and incorporate pulleys and cams to provide mechanical advantages, e.g., to allow the archer to shoot farther and with stronger force. Compound bows are often used in hunting large preys. FIG. 1 depicts both a traditional bow (left) and a compound bow (right). Both are commonly available on the market. The compound bow in FIG. 1 comprises more parts than the traditional bow, for example, two axles, two cams, a grip, a stabilizer, a slight window, etc.

A release aid is an accessory that archers use to achieve a clean release when the bowstring is let go and the arrow is propelled forward by the bowstring. Different types of release aids are commercially available, for example, wrist releases (see FIG. 2), hand releases, hinge releases, etc. A good bow release gives the archer more control, offers smooth and clean releases, and improves accuracy.

The present application discloses a novel and inventive design of an archery bow release that offers great versatility and stability. Because of its unique design, the archery bow releases disclosed herein are also much quieter than the release aids that are currently available on the market.

SUMMARY

Accordingly, it is an objective of the present disclosure to show a new and inventive archery bow release that offers cleaner, smoother and quieter arrow releases than prior art. Compound bows may be used as examples in illustrations or explanations. However, the bow releases disclosed herein can work with both traditional and compound bows.

In some embodiments, an exemplary release mechanism that can be used with an archery bow to produce a smooth arrow release is disclosed. The exemplary bow release comprises a sleeve housing and a center carrier. The center carrier is received in the sleeve housing. The center carrier comprises a chamber and a lock mechanism. The chamber houses the lock mechanism. The chamber has a chamber opening located on the side wall of the center carrier. The chamber opening is aligned with an aperture of the sleeve housing when the center carrier is in a locked position. The lock mechanism locks the center carrier by engaging through the aperture of the sleeve housing and the chamber opening. In some embodiments, the bow release further comprises a string releaser. The string releaser is configured to release the loop bow string of an archery bow when the center carrier is released from the locked position.

In some embodiments, the exemplary bow release comprises a sleeve cylinder housing and a center carrier. The sleeve cylinder housing has a front end and a back end, and an aperture on the side wall. The center carrier is received in the sleeve cylinder housing through the back end. The center carrier comprises a chamber and a lock mechanism housed in the chamber. The chamber has a chamber opening located on the side wall of the center carrier. When the center carrier is in a locked position, the chamber opening is aligned with the aperture of the sleeve cylinder housing. The lock mechanism engages through the aperture and the chamber opening to lock the center carrier. In some embodiments, the bow release further comprises a string releaser. The string releaser is configured to release the loop bow string of the compound bow when the center carrier is released from the locked position.

In one embodiment, the chamber of the center carrier is cylindrical and lies crosswise to the center carrier. In one embodiment, the sleeve cylinder housing and the center carrier are co-axial.

In one embodiment, the lock mechanism of the center carrier comprises a spring and a lock ball bearing positioned on top of the spring. Both the spring and the lock ball bearing are housed in the chamber. The lock ball bearing moves along the chamber when it is pushed by the spring. To lock the center carrier, the spring extends and pushes the lock ball bearing partially outside of the chamber opening. When the lock ball bearing sits in between the chamber opening and the aperture of the sleeve cylinder housing, the center carrier is in a locked position. To unlock the center carrier, a trigger is used to depress a lever and the lever pushes the lock ball bearing into the chamber. Once the lock ball bearing is completely inside the chamber, the center carrier is released from the locked position.

In one embodiment, the trigger is connected to or touches the lock ball bearing and is configured to push the lock ball bearing directly without a level.

In another embodiment, the lock mechanism of the center carrier comprises a spring and two lock ball bearings, referred to as the top lock ball bearing and the bottom lock ball bearing. The lock ball bearings are positioned on top of the spring and can move along the chamber when pushed by the spring. The spring and the lock ball bearing that is in contact with the spring, i.e., the bottom lock ball bearing, are housed in the chamber. When the bottom ball bearing sits in between the chamber opening and the aperture of the sleeve cylinder housing, the center carrier is in a locked position. The top ball bearing sits in between the bottom ball bearing and a trigger. To release the center carrier from the locked position, the trigger is pulled to push the top ball bearing, which in turn pushes the bottom away from the aperture into the chamber, clearing the path for the center carrier to move forward inside the sleeve cylinder housing.

In some embodiments, the lock mechanism comprises a plurality of lock ball bearings, with one of the lock ball bearing configured to lock the center carrier by engaging the chamber opening and the aperture of the sleeve cylinder housing. The trigger is used to push the one lock ball bearing away from the aperture of the sleeve cylinder housing to unlock the center carrier. The trigger can be used in connection with a lever or without a lever to release the center carrier.

In some embodiments, the center carrier further comprises a thumb slide that can be used to push the center carrier back and forth. The center carrier can be pushed forward via the thumb slide when the trigger is pulled and the center carrier is released from the locked position. When the center carrier is in a forward position, the loop draw string can be loaded into a string releaser (more detailed descriptions of an exemplary string releaser can be found below). When the loop draw string is loaded, the thumb slide can be pushed to slide the center carrier towards the back end of the sleeve cylinder housing. The string releaser holds the loop string of the archery bow when the center carrier is locked. In one embodiment, an O-ring is fitted at the back end of the center carrier for stopping and dampening the forward movement of the center carrier.

In some embodiments, instead of a slide, the center carrier comprises a thumb pin for pushing the center carrier forward and backward, when loading a bow string.

In some embodiments, an exemplary archery bow release comprises a bow string releaser and a center carrier. In some embodiments, the bow string releaser comprises two release ball bearings that can be pushed together or apart. In one embodiment, the bow string releaser comprises two release ball bearings and is housed in the center carrier. The center carrier has two defined positions: a locked position and a released position. When the center carrier is released, the center carrier travels from the locked position to the released position. When the center carrier is in the locked position, the two release ball bearings of the bow string releaser are pushed together to hold the bow string. When the center carrier moves from the locked position to the released position, the two release ball bearings remain pushed together. When the center carrier is in the released position, the two release ball bearings of the bow string releaser are apart and release the loop bow string.

In some embodiments, the bow string releaser is located close to the front end of the center carrier. The two ball bearings are installed in a hole drilled across the center carrier near the front end. When the two ball bearings are pushed together, the loop draw string is clamped in between the two ball bearings and the loop draw string becomes loaded. When the two release ball bearings move apart, e.g., when the center carrier moves near the slanted edge of the front end of the sleeve cylinder housing, the loop draw string is let loose and is released.

Other embodiments based on those disclosed herein will be apparent to those ordinarily skilled. Deviations and modifications from the specific examples explained in the present disclosure that are within the inventive spirit of the present disclosure shall be construed as part of the disclosure.

BRIEF DESCRIPTION OF THE DRAWINGS

These and other features of the present disclosure will become readily apparent upon further review of the following specification and drawings. In the drawings, like reference numerals designate corresponding parts throughout the views. Moreover, components in the drawings are not necessarily drawn to scale, the emphasis instead being placed upon clearly illustrating the principles of the present disclosure.

DETAILED DESCRIPTION

Figure 1:
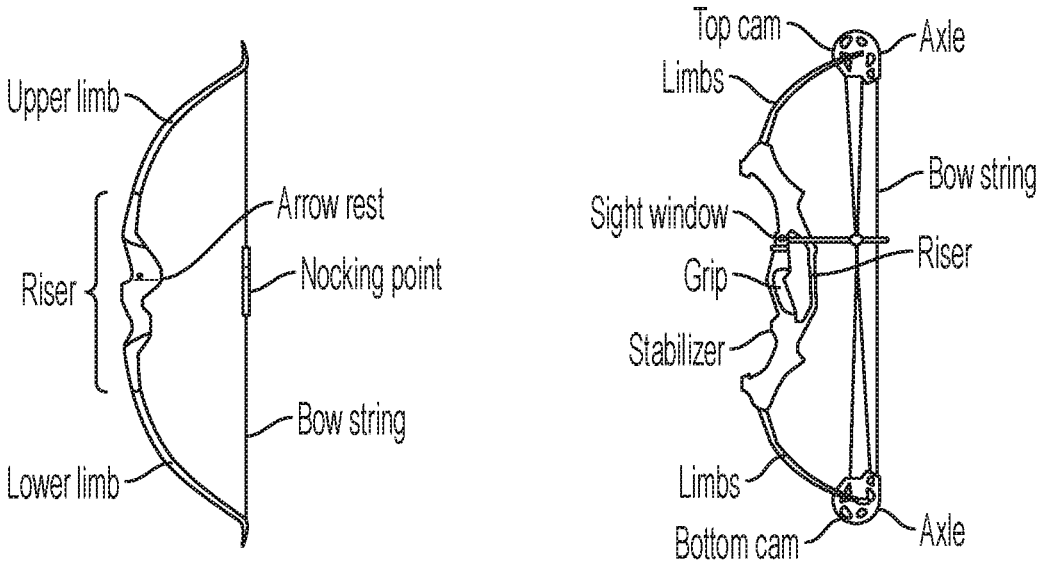
FIG. 1 is an illustration of two archery bows.
Figure 2:
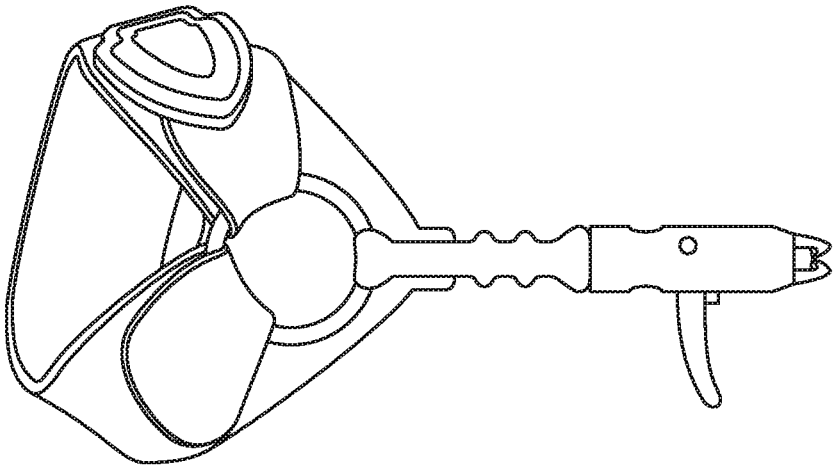
FIG. 2 is an illustration of a wrist release aid used in archery bows.

Embodiments of the disclosure are described more fully hereinafter with reference to the accompanying drawings, in which preferred embodiments of the disclosure are shown. The various embodiments of the disclosure may, however, be embodied in many different forms and should not be construed as limited to the embodiments set forth herein. Rather, these embodiments are provided so that this disclosure will be thorough and complete, and will fully convey the scope of the disclosure to those skilled in the art.

Embodiments of the disclosure are examples used to illustrate the working principles of the apparatus and processes disclosed herein. Features, sizes, and geometric shapes shown in the drawings or described in the specification should not be construed as limiting unless they contribute to or are part of the working principles. For example, geometric shapes, such as cylinders or spheres, are not limiting if they can be replaced with other shapes without impeding the working principles.

Figure 3:
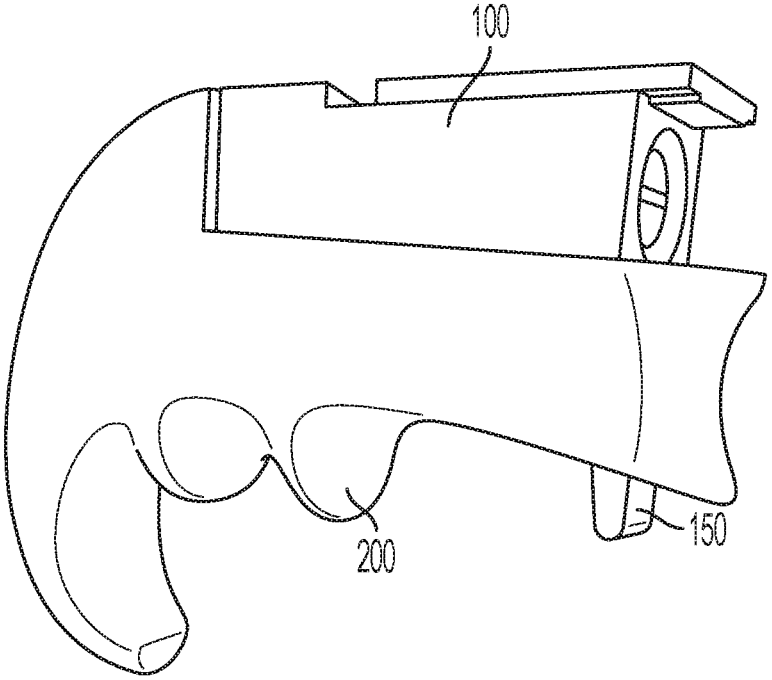
FIG. 3 illustrates an exemplary archery bow release fitted with a handle according to an embodiment of the present disclosure.

In referring to FIG. 3, an exemplary archery bow release 100 with a handle 200 is shown. In one embodiment, the archery bow release 100 is made of metal, e.g., steel, and can be installed in the handle 200 via pins or screws. In some embodiments, the bow release 100 can be made of other types of suitable materials, such as aluminum. The handle 200 may be made of wood, fiberglass, carbon, plastic, etc. Both the archery bow release 100 and the handle 200 may be made of the same or different materials, such as wood, metal, alloy, plastic, and other suitable natural or synthetic materials. The handle 200 has a seat (see FIGS. 11-17) to receive the bow release 100. When the bow release 100 is installed in the seat of the handle 200, the trigger 150 extends out from the bottom side of the handle 200. The handle 200 allows an archer to grip the bow release 100 by hand and rest a finger on the finger perch of the trigger 150.

The archery bow release 100 has a unique design that is different from commercially available bow releases. The archery releases currently sold on the market use two common release techniques: clamp and gate. For example, some commercially available bow releases use a hook to hold a loop bow string. When the trigger is released, the hook lets loose the loop bow string and the force of the bow is released into the bow string and then into the arrow directly. This sudden release of energy causes a distinct noise thump, which is amplified by the bow string. In some cases, the noise could be dampened somewhat by adding a string silencer to the archery bow and by other techniques. In comparison, the new design disclosed herein tunes out the noise by using a variable holding rate trigger that transforms the force generated by the bow into a smooth forward movement of the center carrier 100, resulting in a smoother, quieter, and more accurate bow release.

Figure 7:
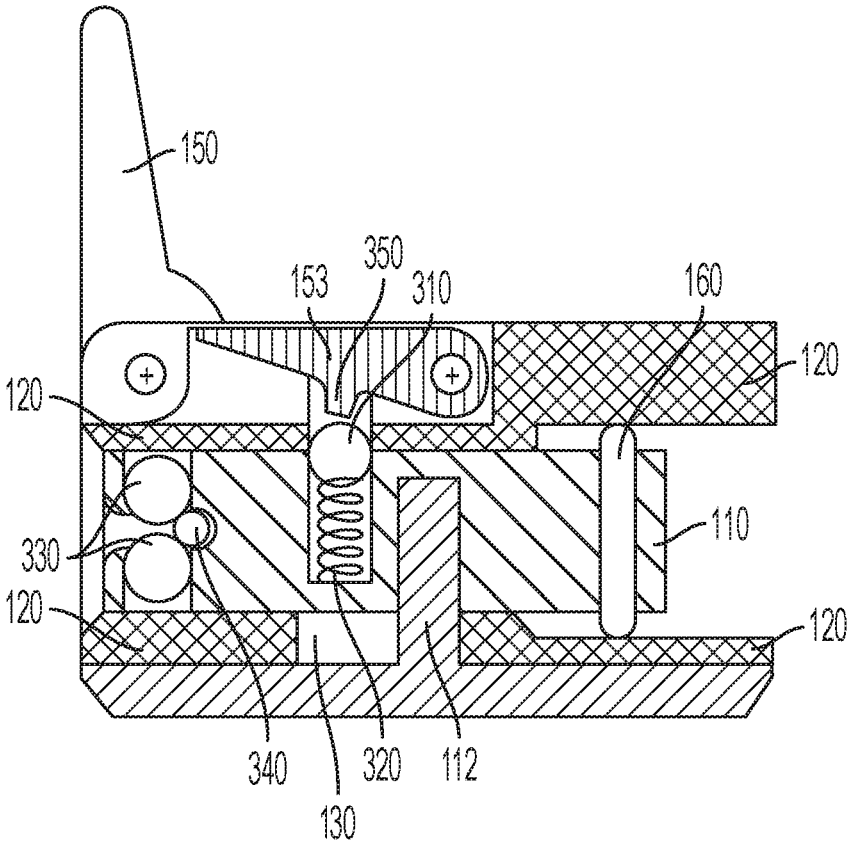
FIG. 7 is a cross-sectional view of an exemplary archery bow release when the release is in a released position.
Figure 8:
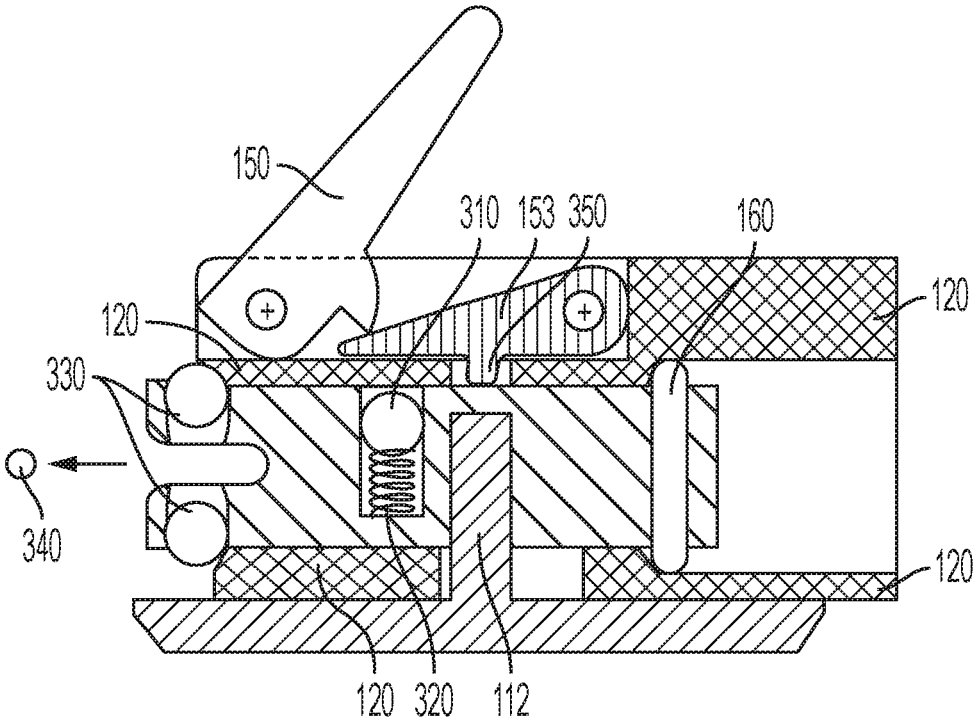
FIG. 8 is another cross-sectional view of an exemplary archery bow release when the release is in a locked position.

The new release design disclosed herein uses a release mechanism that comprises a plurality of release ball bearings, e.g., two release ball bearings 330 shown in FIG. 7 and FIG. 8, and a central carrier 110 that houses the release ball bearings. The two release ball bearings 330 are configured to hold and release a bow string. The center carrier 110 has a locked position and a released position. The new design divides the release of the loop bow string into two stages. In stage one, the center carrier 110 is released from its locked position when the trigger is pulled. When the holding pressure on the bow string becomes less than the pulling force from the string, the center carrier 110 starts to move forward. Stage two occurs when the center carrier is pulled forward by the bow string, accelerates, and moves outside a sleeve housing 120. This reduces the holding pressure on the two release ball bearings 330 and opens the two release ball bearings. The two ball bearings separate and release the bow string. In this two-stage release process, the holding force provided by the two release ball bearings is not constant.

When the two ball bearings are pushed together, they hold the loop bow string. When the two ball bearings move apart, the loop bow string is released and slips through in between the two ball bearings. Compared to the hooks used in prior art releases, the archery bow release 100 offers a smoother release of the bow string because there is little friction between the two ball bearings as the bow string slips through. With little friction, the bow string suffers substantially reduced wear and tear and has a longer lifetime. Also, with substantially reduced friction, the bow string makes little noise when it is released. The release becomes much quieter.

In the embodiments described below, the sleeve housing 120 is a cylindrically shaped and is referred to as the sleeve cylinder housing 120. Other shapes can be adopted if doing so does not affect the effectiveness of the archery bow release.

Figure 4A:
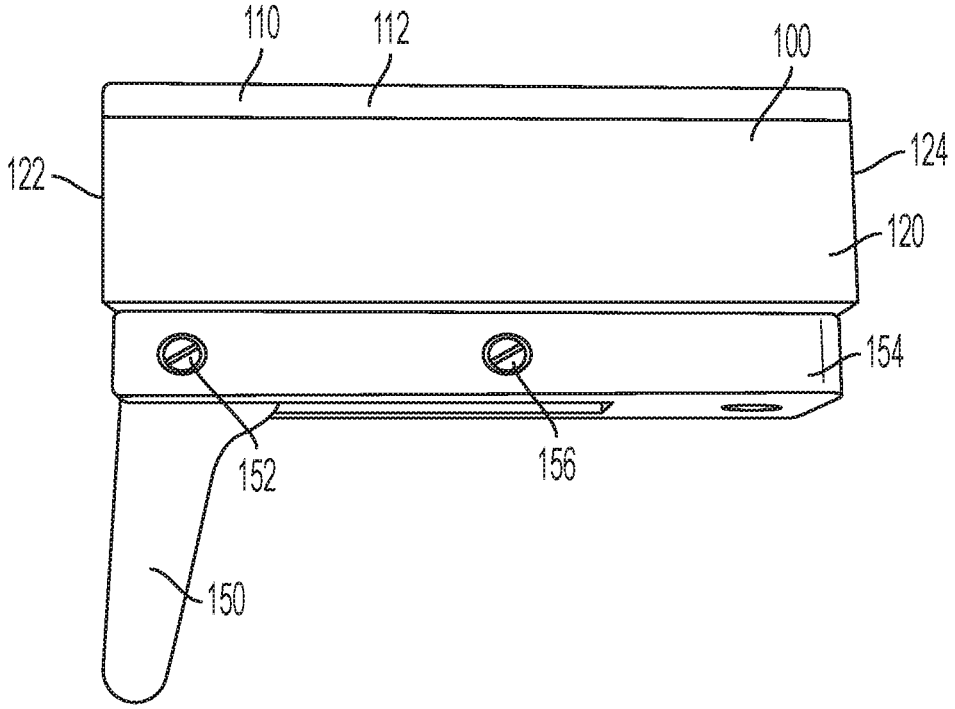
FIGS. 4A-4C illustrate an exemplary sleeve cylinder housing according to an embodiment of the present disclosure.
Figure 4B:
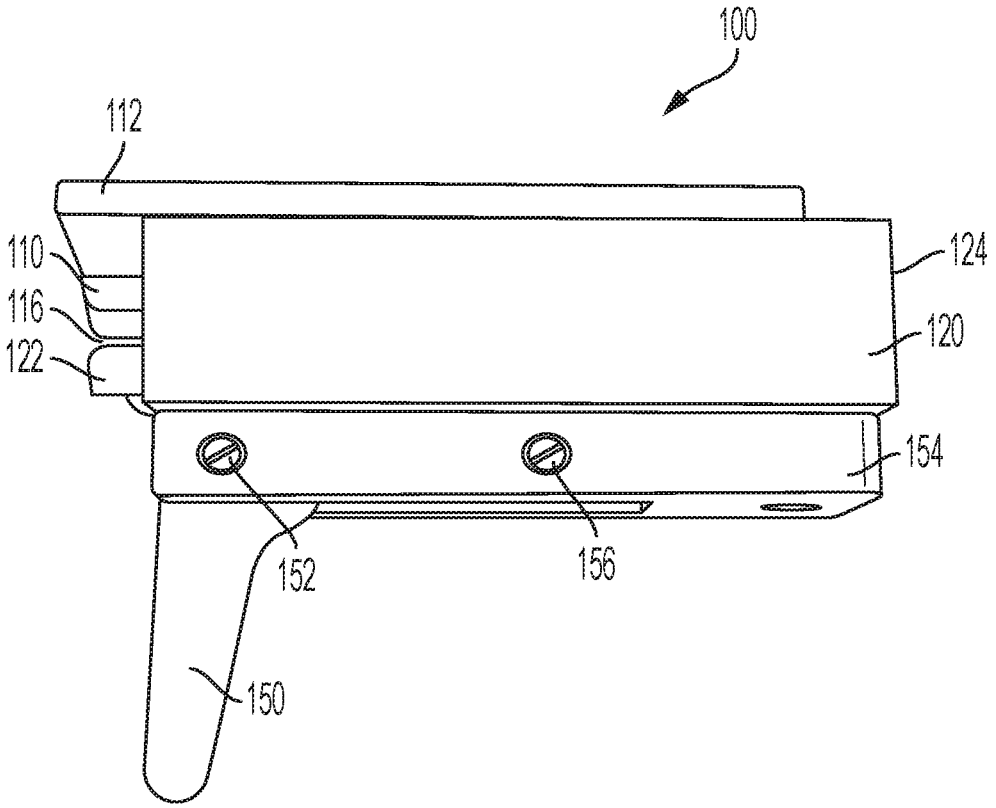
Figure 4C:
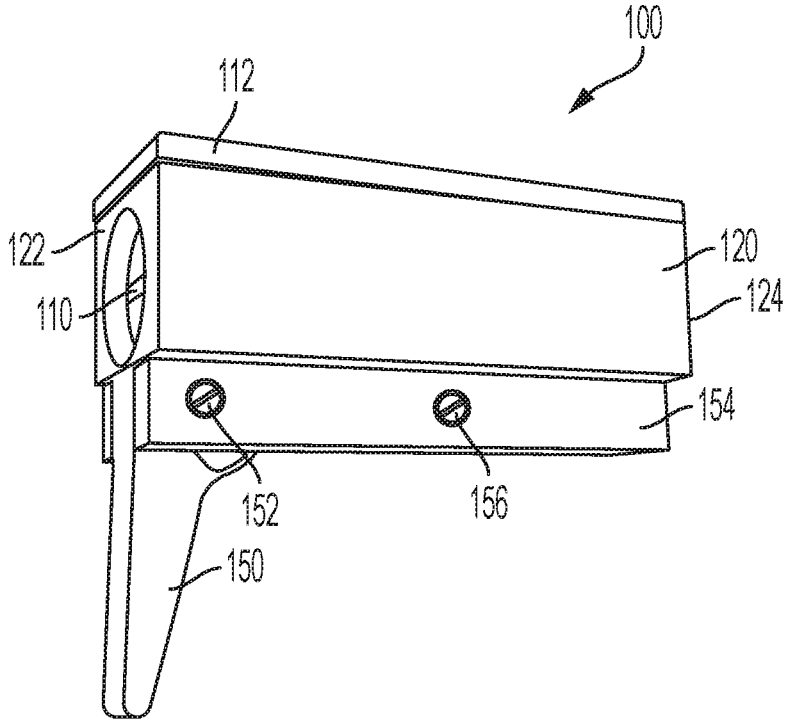

FIGS. 4A-4C illustrate different exterior views of the bow release 100. FIG. 4A is a side view of the bow release 100. The bow release 100 comprises a sleeve cylinder housing 120, a center carrier 110, and a trigger 150. The trigger 150 is attached to the flange 154 of the sleeve cylinder housing 120 by two pins 152 (one on each side). The pins 156 are used to affix a lever (not shown in FIG. 4A, see FIG. 7) to the trigger 150. The sleeve cylinder housing 120 has a front end 122 and a back end 124. The center carrier 110 is received in the sleeve cylinder housing 120 through the back end 124. The center carrier 110 comprises a thumb slide 112, shown as a flat piece on top of the center carrier 110 in FIG. 4*a*. The thumb slide 112 is designed to allow the center carrier 110 to be pushed, by a finger, e.g., a thumb, forward and backward along the sleeve cylinder housing 120.

FIG. 4B illustrates a side view of the exemplary bow release 100 with the center carrier 110 in a forward position (released position). When the center carrier 110 has slid forward out of the front end 122 of the sleeve cylinder housing 120, the front end of the center carrier 110 becomes exposed. The front end of the center carrier 110 is where the string releaser 114 (not labeled in FIG. 4B) is located. The string releaser 114 comprises a slot 116, which can be used to load a bow string.

FIG. 4C is a perspective view of the exemplary bow release 100 with the center carrier 110 in a locked position. The string releaser 114 backs into the sleeve cylinder housing 120 as the center carrier 110 is pushed backward towards the back end 124 of the sleeve cylinder housing 120.

Figure 5:
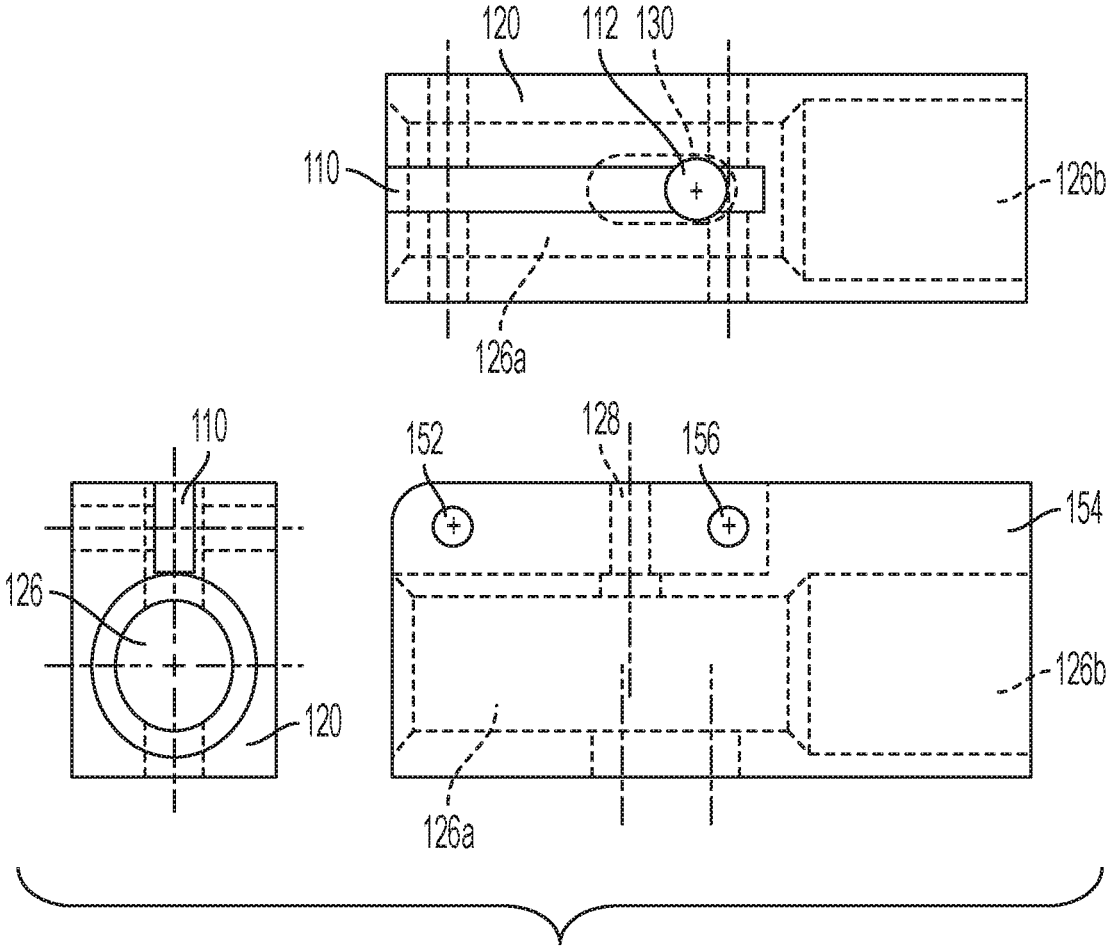
FIG. 5 illustrates different views of an exemplary sleeve cylinder housing used in an archery bow release according to an embodiment of the present disclosure.

FIG. 5 is a set of engineering drawings of the sleeve cylinder housing 120. The front view illustrated in FIG. 5 (lower left) is a view of the sleeve cylinder housing 120 from the front end 122. The center of the sleeve cylinder housing 120 is a cylindrical hollow space 126 for housing the center carrier 110. As illustrated in the side view of the housing 120 (lower right), the cylindrical hollow space 126 comprises two sections of different diameters. The narrower section 126*a* is at the front end 122 and the wider section 126*b* is at the back end 124. The wider section 126*b* of the sleeve cylinder housing receives the center carrier 110 from the back end 124, and allows the center carrier 110 to be inserted into the narrower section 126*a* with ease. The top view in FIG. 5 is a view of the sleeve cylinder housing 120 from the top. The thumb slide 112 is situated on the top of the center carrier 110 and can slide in the channel 130. The side view in FIG. 5 (lower right) illustrates an upside-down view of the sleeve cylinder housing 120 as compared to the bow release 100 shown in FIG. 4C. In the side view of FIG. 5, an aperture 128 located on the side wall of the sleeve cylinder housing 120 is shown to be in between the two sets of pins, 152 and 156. The aperture 128 accommodates the lever that works in connection with the trigger 150. The trigger 150, which can be attached to the flange 154 of the sleeve cylinder housing 120 using the pins 152 (one on each side), is not included in the side view of FIG. 5.

Figure 6:
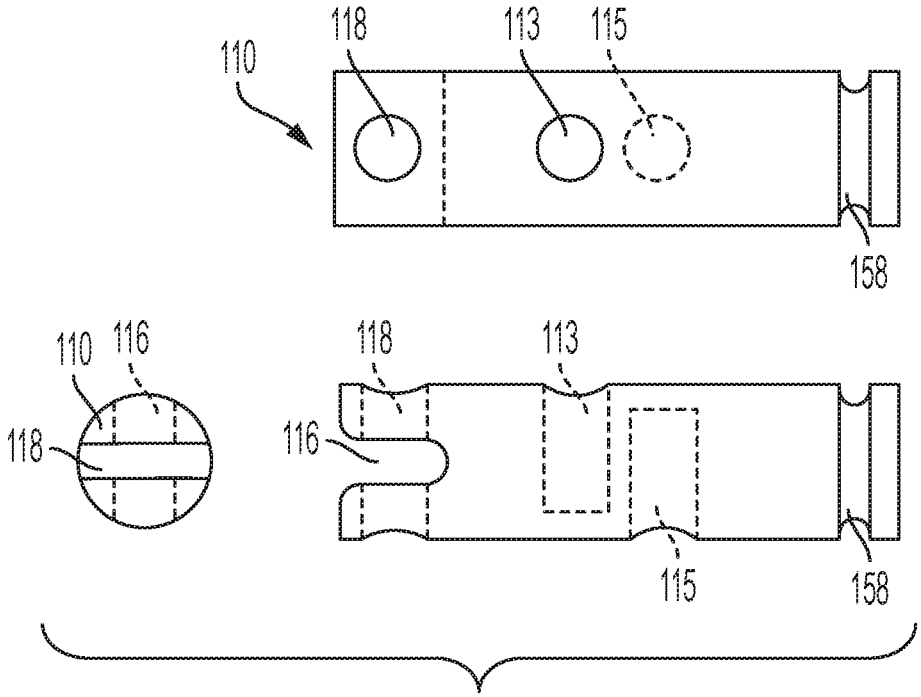
FIG. 6 illustrates different views of an exemplary center carrier according to an embodiment of the present disclosure.

FIG. 6 is a set of engineering drawings of the center carrier 110. FIG. 6 shows three views of the center carrier 110. The front view (lower left) illustrates a slot 116 cutting across the center carrier 110 and a hole 118 drilled perpendicular to the slot 116. The slot 116 is used to load a loop bow string. Perpendicular to the slot 116, the hole 118 in the shape of a tunnel is drilled across the center carrier 110, also shown in the side view and the top view of FIG. 6. To be explained in more detail in FIG. 7, the slot 116, the hole 118, and two release ball bearings installed inside the hole 118 form the string releaser 114. The side view of the center carrier 110 (lower right) also shows a cavity 115 and a chamber 113. The cavity 115 houses the thumb slide 112 (see FIG. 7) or thumb pin 360 (see FIG. 10). The chamber 113 houses the lock mechanism, e.g., one or more lock ball bearings on top of a spring, for locking the center carrier 110. The chamber 113, the cavity 115, and the hole 118 are shown as circles in the top view of the center carrier 110 (top). In both the top view and the side view, a groove 158 is shown to be located near the back end of the center carrier 110. An O-ring can be fitted into the groove 158. The O-ring is used to stop the forward movement of the center carrier 110.

FIG. 7 and FIG. 8 are two drawings illustrating a cross-sectional view of an assembled bow release 100. In both FIG. 7 and FIG. 8, the center carrier 110 is received in the sleeve cylinder housing 120. As shown in FIG. 5, the back end 124 of the sleeve cylinder housing 120 is open. The center carrier 110 can be inserted into the sleeve cylinder housing 120 through the back end 124. An O-ring 160 fitted in the groove 158 near the back end of the center carrier 110 stops the forward movement of the center carrier 110, because the O-ring 160 cannot pass through the narrower section 126*a* of the cylindrical hollow space 126 inside the sleeve cylinder housing.

Shown in FIG. 7 is the bow release 100 in a locked position. In FIG. 7, the trigger 150 is in an upright position and the lever 153 is in a horizontal position. The lever 153 includes a protuberance 350 that comes into the aperture 128 of the sleeve cylinder housing 120. The center carrier 110 is locked within the sleeve cylinder housing 120 through a lock mechanism. The lock mechanism comprises a lock ball bearing 310 and a spring 320, both housed inside the chamber 113 of the center carrier 110. The lock ball bearing 310 sits on top of the spring 320 and can move along the chamber 113 when pushed by the spring 320. When the lever 153 is in a horizontal position as shown in FIG. 7, the protuberance 350 holds the lock ball bearing in an engaged position between the aperture 128 of the sleeve cylinder housing 120 and the chamber opening 113 of the center carrier 110.

In FIG. 7, the ball bearing 310 is pushed by the spring 320 into the aperture 128 (see FIG. 5) of the sleeve cylinder housing 120 and is stopped by the protuberance 350 of the lever 153. The ball bearing 310 sits in between the chamber opening 113 of the center carrier 110 and the aperture 128 of the sleeve cylinder housing 120. The center carrier 110 and the sleeve cylinder housing 120 are locked by the lock ball bearing 310. The center carrier 110 cannot slide within the sleeve cylinder housing 120 when the lock ball bearing 310 is engaged in the aperture 128 and the chamber opening 113 of the center carrier 110.

The thumb slide 112 shown in FIG. 7 as a "T" structure is positioned at the right most end of the channel 130 (see FIG. 5). The horizontal portion of the thumb slide 112 is a flat piece of metal, plastic, or other suitable materials. The vertical portion of the thumb slide 112 is inserted into the cavity 115 of the center carrier 110 (see FIG. 6). By placing a finger on the flat surface of the thumb slide 112, an archer can push the thumb slide 112 forward or backward inside the channel 130 to move the center carrier 110 when the center carrier 110 is not locked.

At the front end of the center carrier 110, two release ball bearings 330 are housed inside the hole 118 (see FIG. 6). The two release ball bearings 330 sit across the slot 116 and can move along the hole 118. The two ball bearings 330 are also confined within the hole 118 by the wall of the sleeve cylinder housing 120. When the bow string 340 is loaded into the release 100, the bow string 340 is clamped by the two release ball bearings 330 and is held by the bow release 100 when it is in a locked position.

To release the bow string 340, the archer pulls the trigger 150. FIG. 8 illustrates the bow release 100 in a released position. When the trigger 150 is pulled, that is, the trigger 150 moves toward the right side in FIG. 8. The tip of the trigger 150 pushes the lever 153. The protuberance 350 of the lever 153 in turn pushes the lock ball bearing 310 into the chamber 113 of the center carrier 110, away from the aperture 128 on the sleeve cylinder housing 120. When the lock ball bearing 310 disengages the center carrier 110 from the sleeve cylinder housing 120, the draw force from the bow string 340 loaded onto the center carrier 110, which has the bow string 340 clamped in between the release ball bearings 330, pulls the center carrier 110 forward to the front end 122 of the sleeve cylinder housing 120.

As the center carrier 110 is pulled forward by the clamped bow string 340, the front end 122 of the center carrier 110 moves outside of the sleeve cylinder housing 120. The two release ball bearings 330 are no longer confined by the walls of the sleeve cylinder housing 120. The clamped bow string 340 pushes the two releases ball bearings 330 apart and slips through in between them. The bow string 340 is released from the bow release 100.

When the bow string 340 is released, the two release ball bearings 330 are slightly apart and slightly outside of the hole 118. But the two release ball bearings 330 are constrained by the slanted edges of the sleeve cylinder housing 120 at the front end 122, which prevents the two release ball bearings 330 from falling off.

When the bow release 100 is in a released position shown in FIG. 8, the thumb slide 112 has also moved with the center carrier 110 to a forward position. The thumb slide 112 is now at the leftmost end of the channel 130 (see FIG. 5). The O-ring 160 fitted in the groove 158 of the center carrier 110 has a diameter larger than the diameter of the narrower section 126*a* of the cylindrical hollow space inside the sleeve cylinder housing 120. The O-ring 160 cannot pass through the narrower section 126*a* and stops the forward movement of the center carrier 110.

The O-ring 160 may be made of silicon, rubber, plastic, or other suitable materials. The O-ring 160 acts as a pneumatic dampener and stopper for the center carrier 110. The O-ring also absorbs the shock from the center carrier 110. Because of the O-ring 160, the bow release 100 generates little or no noise when the center carrier is released. Additionally, as mentioned above, the loop bow string releaser comprises two release ball bearings, instead of a hook that is commonly used in prior art bow releases. The two release ball bearings 320, because of their smooth surface, also generate little noise when the bow string 340 slips through. As a result, the bow release 100 as disclosed herein is much quieter than those bow releases that are currently available on the market.

Furthermore, when the bow release 100 is loaded, the bow string 340 is clasped in between two release ball bearings 320 that are identical and situated in the hole 118 drilled across the center carrier 110. Throughout the two-stage release, the bow string 340 stays in the center as the center carrier 110 moves forward in the sleeve cylinder housing 120. This ensures that the two-stage release produces accurate and smooth releases.

Figure 9:
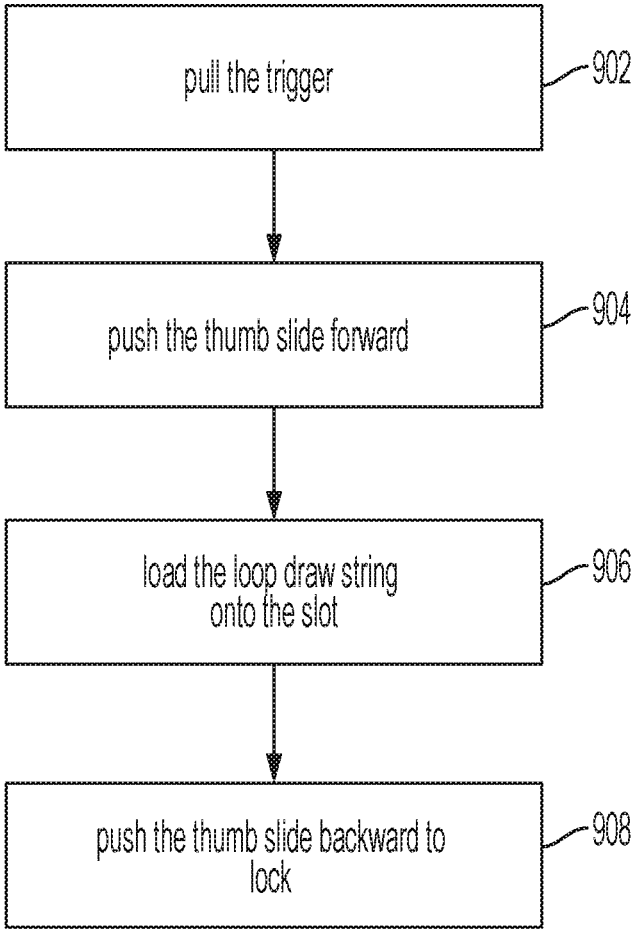
FIG. 9 is a flow char illustrating an exemplary process of loading a bow string into a bow release in accordance to an embodiment disclosed herein.

FIG. 9 illustrates a flow chart of a loading process of the bow string 340. To load, the archer pulls the trigger 150 (step 902) and pushes the thumb slide 112 forward (step 904). The center carrier 110 is in a released state. The front end of the center carrier 110 moves outside of the sleeve cylinder housing 120, exposing the slot 116. The archer pulls the bow string 340 into the slot 116 to load (step 906). While still holding the bow string 340, the archer pushes the thumb slide 112 backward (step 908). The center carrier 110 retreats into the sleeve cylinder housing 120. The two release ball bearings 330 are pushed together by the wall of the sleeve cylinder housing 120, clamping and locking the loop drawing string 340. When the center carrier 110 slides to the back end 124 of the sleeve cylinder housing 120, the archer can then let go the trigger 150. The trigger 150 releases the lever 153, which releases the ball bearing 310. Being pushed by the spring 320, the ball bearing 310 moves partially into the aperture 128 of the sleeve cylinder housing 120, engaging the center carrier 110 with the sleeve cylinder housing 120, locking the bow release. The loop bow string is loaded and the archery bow is ready for shooting.

Figure 10:
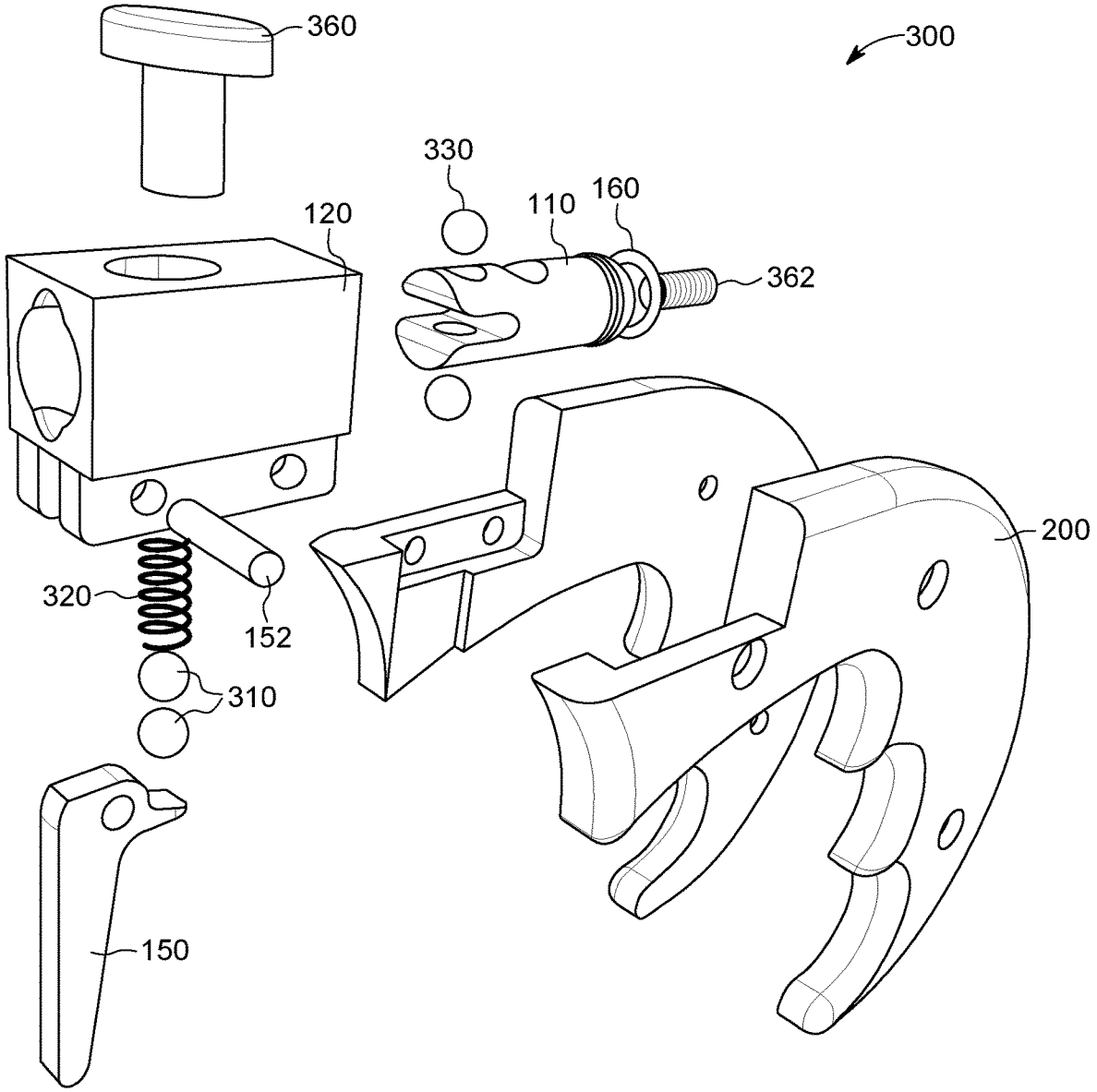
FIG. 10 illustrates an exploded view of another archery bow release embodiment.
Figure 11:
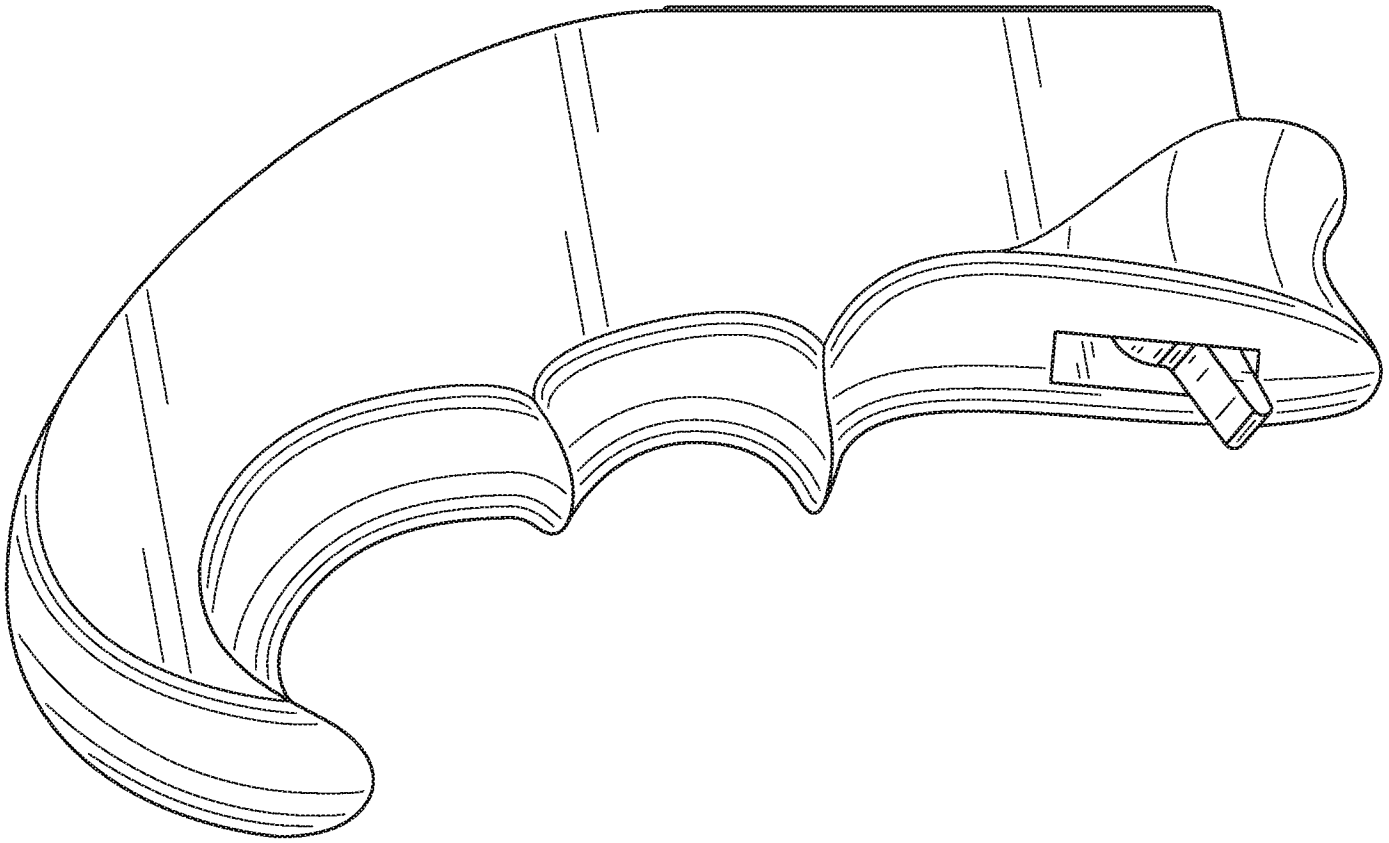
FIG. 11 is a perspective view of a first design of an archery bow release.
Figure 12:
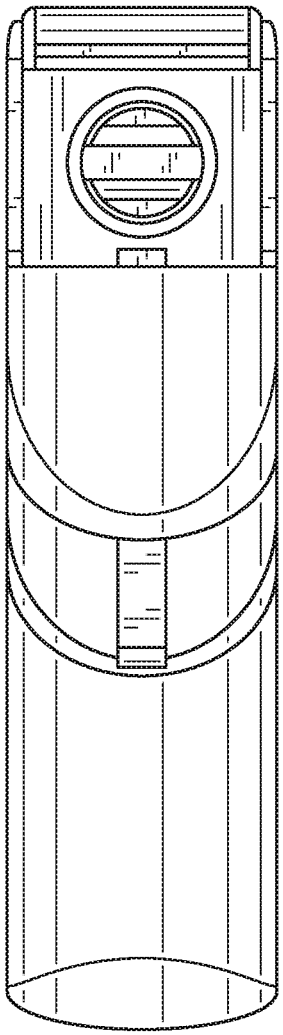
FIG. 12 is a front view thereof.
Figure 13:
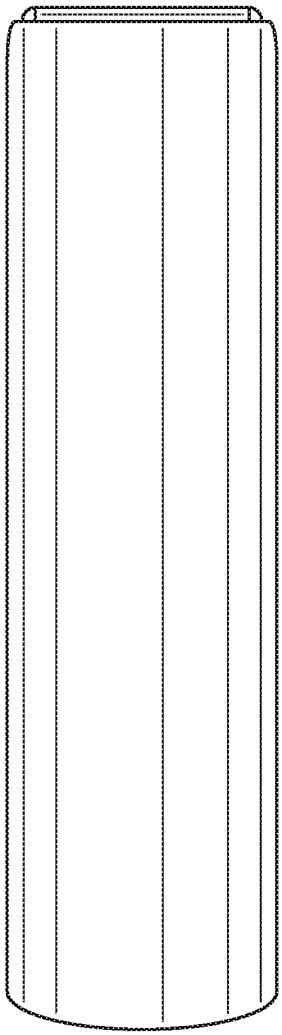
FIG. 13 is a back view thereof.
Figure 14:
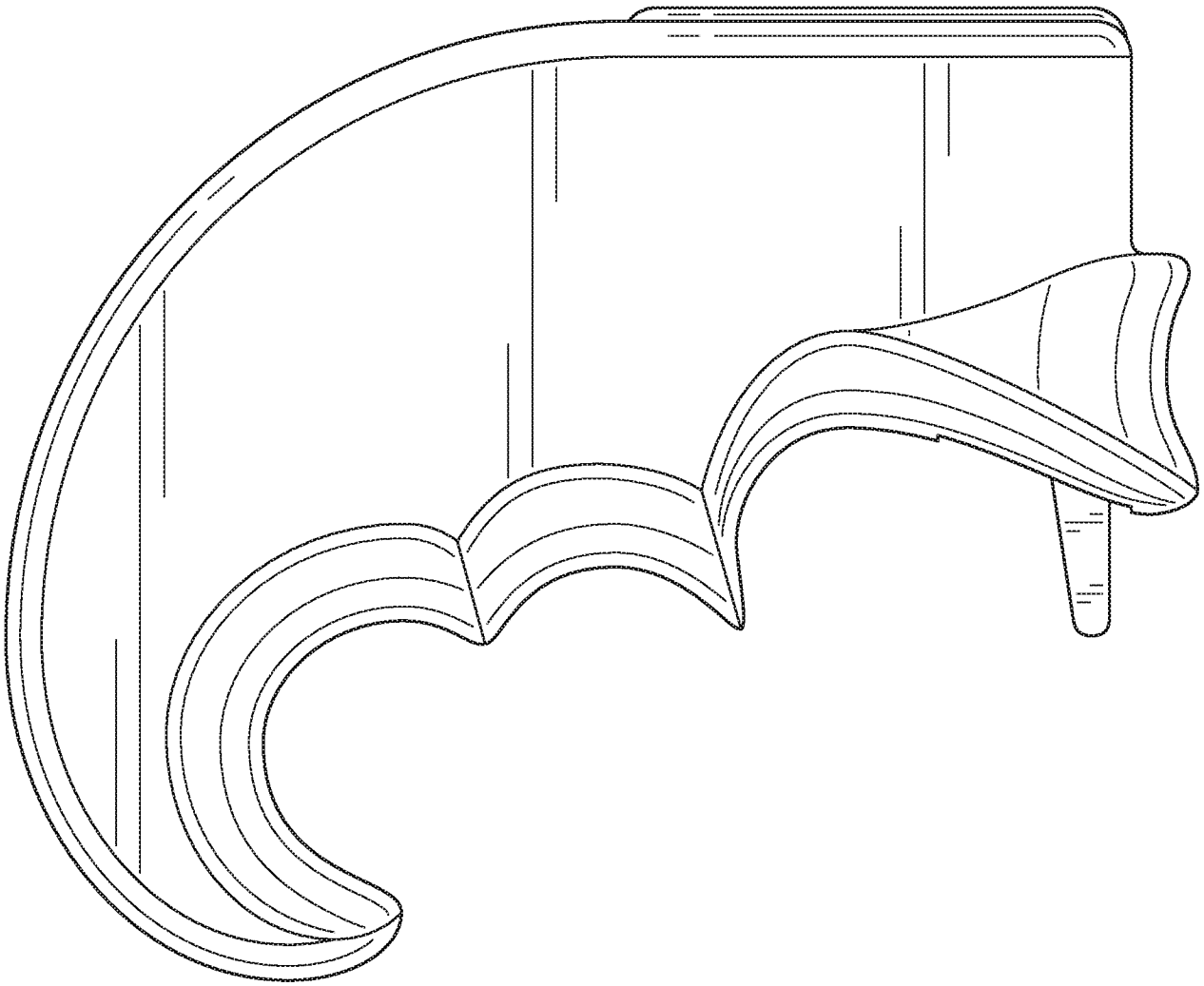
FIG. 14 is side view thereof.
Figure 15:
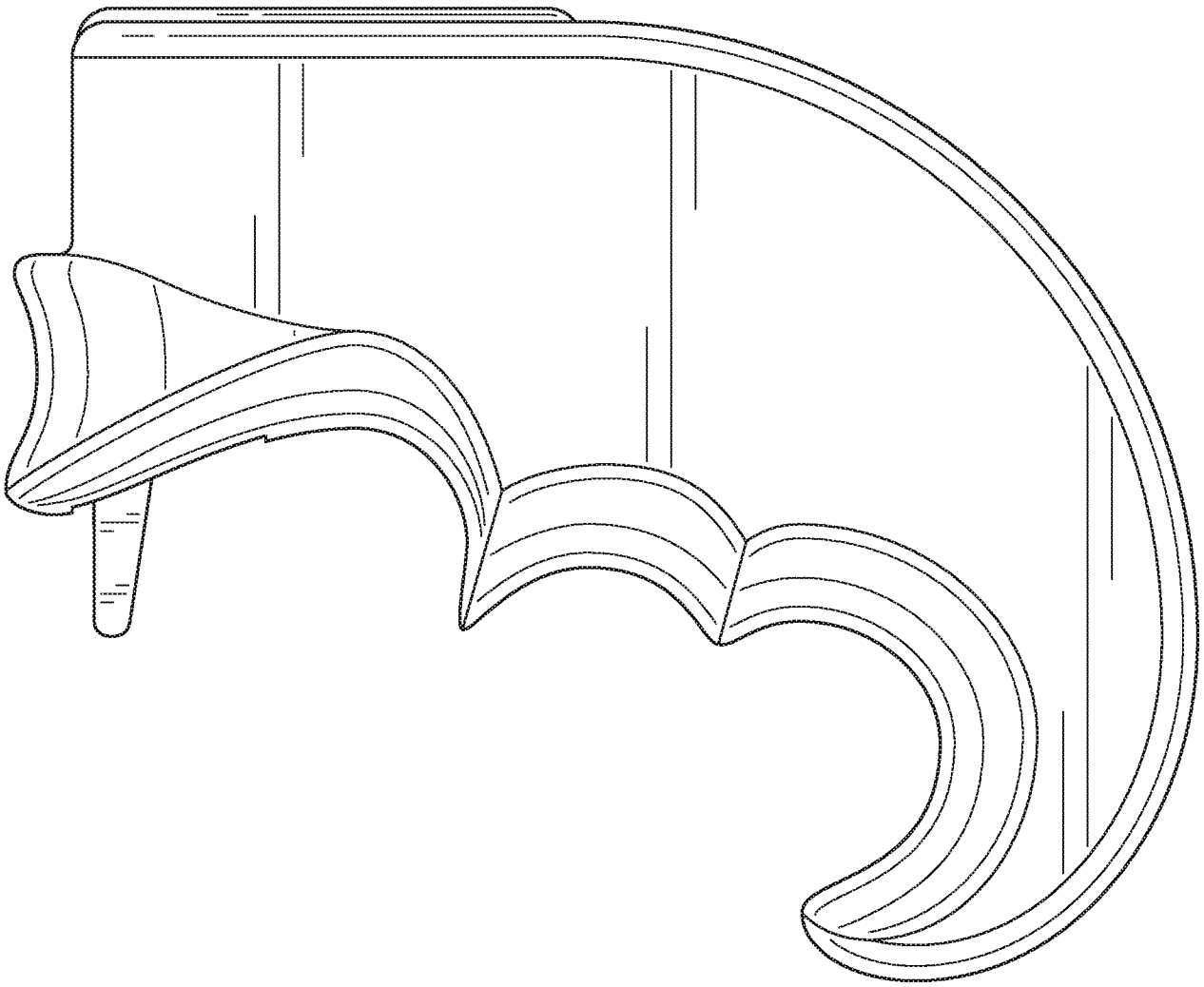
FIG. 15 is another side view thereof.
Figure 16:
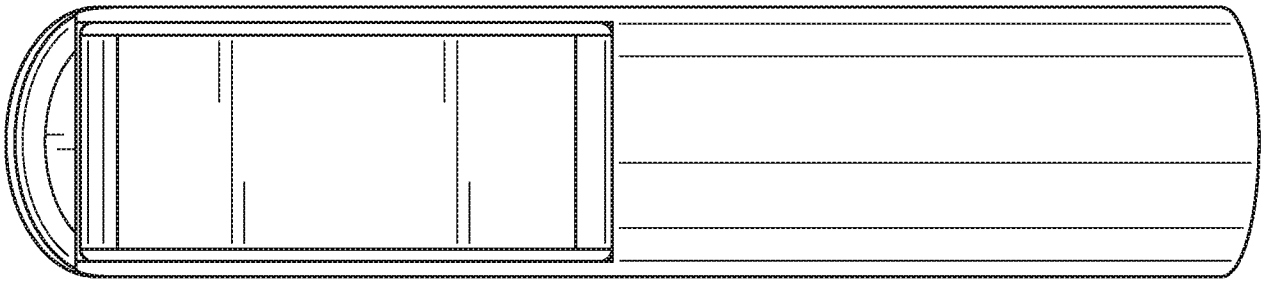
FIG. 16 is a top view thereof.
Figure 17:
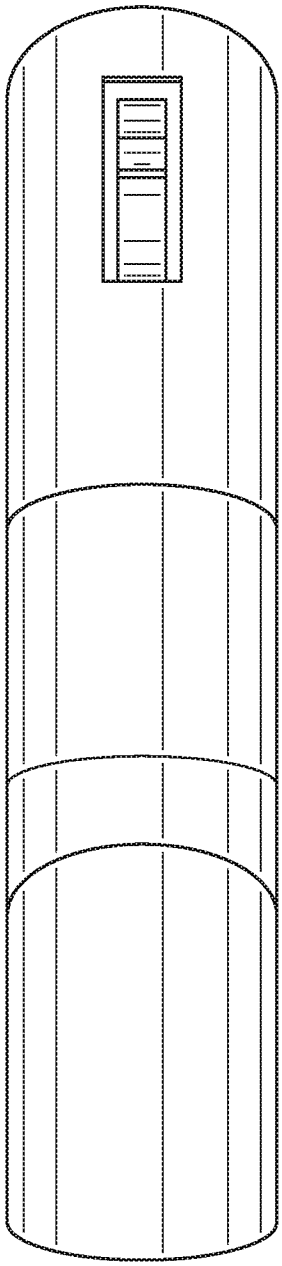
FIG. 17 is a bottom view thereof.
Figure 18:
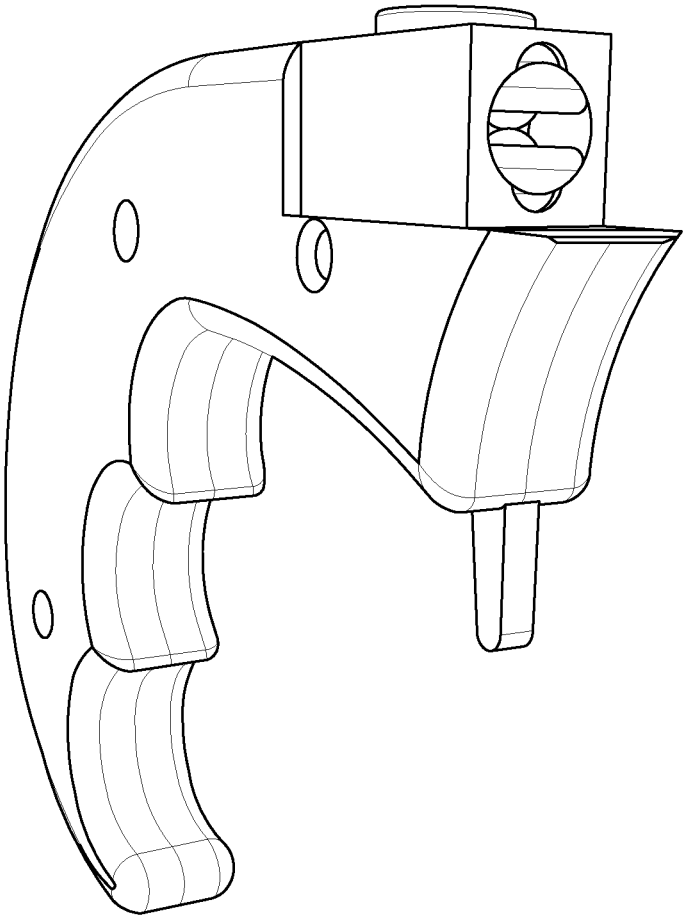
FIG. 18 is a perspective view of a second design of an archery bow release.
Figure 19:
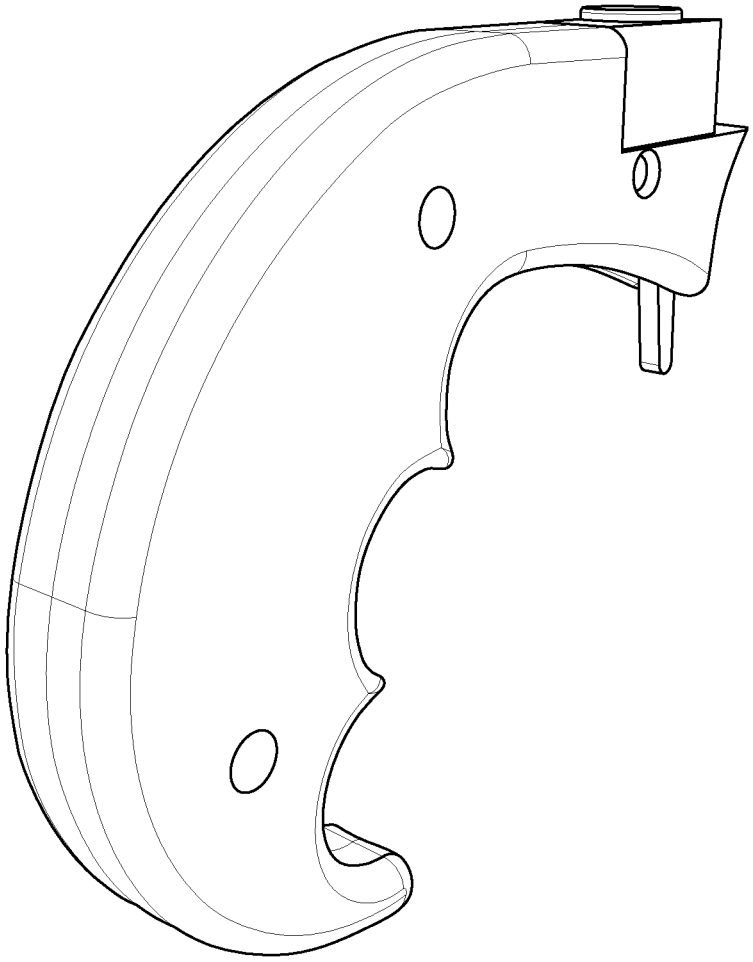
FIG. 19 is another perspective view of the second design of an archery bow release.

FIG. 10 illustrates another bow release embodiment in an exploded view. The bow release 300 in FIG. 10 comprises a sleeve cylinder housing 120, a center carrier 110, and a trigger 150, similar to the bow release 100 disclosed in earlier figures. The sleeve cylinder housing 120 is configured to receive the center carrier 110 from the back end 124. The center carrier 110 comprises similar structures as the bow release 100 shown in FIGS. 4A-4C, namely, a chamber 113, a lock mechanism and a string releaser. Different from the bow release 100, the lock mechanism of the bow release 300 comprises two lock ball bearings 310 and a spring 320. Also in the bow release 300, the trigger 150 is in direct contact with the lock ball bearings 310. When pulled, the trigger 150 pushes the lock ball bearings 310 to unlock the center carrier 110, instead of via a lever. Also different from the bow release 100, the sleeve cylinder housing 120 in the bow release 300 comprises a thumb pin 360, instead of a thumb slide 112, to allow an archer to push the center carrier 110 back and forth. In FIG. 10, a pin 152 is used to connect the bow release 300 with the handle 200, for ease of gripping. A screw 362 is used to secure the O-ring 162 onto the center carrier 110.

A handle 200 can be made of different materials. For example, in FIG. 3, the bow release 100 is installed in a wooden handle 200. But other suitable materials, such as metal, plastic, nylon, fiberglass, etc., can be used to construct the handle 200 as well. The ornamental features of the handle 200 are illustrated in two design embodiments as shown in FIGS. 11-19.

Although the disclosure is illustrated and described herein with reference to specific embodiments, the disclosure is not intended to be limited to the details shown. Rather, various modifications may be made in the details within the scope and range of equivalents of the claims and without departing from the disclosure.

What is claimed is:

1. An archery bow release, comprising:

a sleeve cylinder housing having a front end and a back end and an aperture on a side wall of the sleeve cylinder housing; and a center carrier that is received in the sleeve cylinder housing through the back end of the sleeve cylinder housing, wherein the center carrier has a locked position and a released position, said center carrier comprising:

a chamber, wherein said chamber has a chamber opening located on the side wall of the center carrier, and wherein the chamber opening aligns with the aperture of the sleeve cylinder housing when the center carrier is in a locked position;

a lock mechanism that is housed in the chamber and configured to engage through the aperture and the chamber opening to lock the center carrier, the lock mechanism defining a biased protrusion that is biased outward toward the chamber opening to maintain the center carrier in the locked position;

a string releaser configured to:

hold a bow string of a compound bow when the center carrier is in the locked position, and release the bow string when the center carrier is in a released position;

a trigger having a relaxed and a pulled orientation, the trigger being operably coupled with the lock mechanism to translate the lock mechanism away from the chamber opening when the trigger is in the pulled orientation to allow the center carrier to slidably translate within the sleeve cylinder housing to the released position, wherein the translation of the center carrier is towards the bow string in response to a biasing force imparted by the bow string to the center carrier, wherein the center carrier further comprises a resilient stop at the back end of the center carrier for stopping a forward movement of the center carrier.

2. The archery bow release of claim 1, wherein the sleeve cylinder housing is cylindrical and wherein the chamber is cylindric and lies crosswise to the center carrier.

3. The archery bow release of claim 1, wherein the biased protrusion comprises a spring and a lock ball bearing, and wherein the spring and the ball bearing are housed inside the chamber and the lock ball bearing moves along the chamber when it is pushed by the spring.

4. The archery bow release of claim 3, wherein the center carrier is in the locked position when the lock ball bearing is situated in between the aperture of the sleeve cylinder housing and the opening of the chamber, and the center carrier is released from the locked position when the lock ball bearing is situated entirely inside the chamber.

5. The archery bow release of claim 3, wherein, when the trigger is pulled, the trigger pushes the lock ball bearing into the chamber to unlock the center carrier from the locked position.

6. The archery bow release of claim 5, further comprising a lever connected to the trigger and configured to push the lock ball bearing into the chamber.

7. The archery bow release of claim 1, further comprising a thumb slide or pin for pushing the center carrier when the center carrier is released from the locked position.

8. The archery bow release of claim 1, wherein the biased protrusion comprises a spring and two lock ball bearings positioned on top of the spring, and wherein the spring and one lock ball bearing are housed inside the chamber and wherein the lock ball bearings move along the chamber when they are pushed by the spring.

9. The archery bow release of claim 8, wherein, when the trigger is relaxed, one of the two lock ball bearing is situated in between the aperture of the sleeve cylinder housing and the opening of the chamber tolock the center carrier in the locked position, and wherein, when the trigger is pulled, the two lock ball bearings are pushed by the trigger to unlock the center carrier.

10. The archery bow release of claim 1, wherein, when the center carrier is pushed forward to the released position, the string releaser moves out of the front end of the sleeve cylinder housing in response to biasing forces imparted by the bow string to the center carrier to allow the bow string to be loaded into a slot of the string releaser.

11. The archery bow release of claim 1, wherein the sleeve cylinder housing and the center carrier are coaxial.

12. An archery bow release, said bow release comprising:

a sleeve cylinder housing having a front end and a back end and an aperture on a side wall of the sleeve cylinder housing; and a center carrier that is received in the sleeve cylinder housing through the back end of the sleeve cylinder housing, comprising:

a chamber, wherein said chamber has a chamber opening located on the side wall of the center carrier, and wherein the chamber opening aligns with the aperture when the center carrier is in a locked position;

a lock mechanism that is configured to engage through the aperture and the chamber opening to lock the center carrier; and a string releaser for releasing a bow string of a compound bow, said string releaser comprising two release ball bearings, wherein the two release ball bearings are pushed together when the center carrier is in the locked position and are separate when the center carrier is in a released position, wherein an inner edge of the sleeve cylinder housing at the front end is slanted to allow the release ball bearings to move apart when the center carrier moves outside of the sleeve cylinder housing when the center carrier is in the released position.

13. The bow release of claim 12, wherein the center carrier comprises a slot at the front end of the center carrier for receiving a loop bow string, and wherein the loop bow string is clamped in between the two release ball bearings when the center carrier is in the locked position and the loop bow string is released when the two release ball bearings move apart.

14. The bow release of claim 12, wherein the string releaser is located at the front end of the center carrier in close proximity to the front end of the sleeve cylinder housing.

15. The bow release of claim 13, wherein the two release ball bearings of the string releaser are inside a hole drilled across the slot in the center carrier.

16. The bow release of claim 13, wherein the two release ball bearings are identical, and the diameter of the release ball bearings is half of the diameter of the center carrier.

17. The bow release of claim 12, further comprising a thumb slide or pin for pushing the center carrier to move forward or backward.

18. The bow release of claim 17, wherein the edge of the sleeve cylinder housing at the front end restrains the release ball bearings when the center carrier slides outside the sleeve cylinder housing by a distance that is controlled by the thumb slide and an O-ring.

19. An archery bow release, comprising:

a sleeve cylinder housing having a front end and a back end and an aperture on a side wall of the sleeve cylinder housing; and a center carrier that is received in the sleeve cylinder housing through the back end of the sleeve cylinder housing, comprising:

a chamber wherein said chamber has a chamber opening located on the side wall of the center carrier, and wherein the chamber opening aligns with the aperture when the center carrier is in a locked position;

a lock mechanism that is configured to engage through the aperture and the chamber opening to lock the center carrier; and a string releaser for releasing a bow string of a compound bow, said string releaser comprising two release ball bearings, wherein the two release ball bearings are movably housed in the center carrier;

wherein, when the center carrier is in the locked position, the two release ball bearings are pushed together for holding a bow string by an inner surface of the sleeve cylinder housing;

wherein, when the center carrier is in the released position, the two release ball bearings are spaced-apart to release the bow string, wherein the center carrier is translated along the length of the sleeve cylinder housing until the center carrier is in the released position, wherein the center carrier is translated in response to a biasing force imparted by the bow string to the center carrier, wherein the biasing force imparted by the bow string translates the center carrier without further translation forces being provided along the length of the sleeve cylinder housing by a spring or further translation forces being provided along the length of the sleeve cylinder housing due to movement of the lock mechanism, wherein the center carrier is not fixedly constrained to a back surface of the housing.

* * * * *